United States Patent [19]

Olsen

[11] 4,223,972

[45] Sep. 23, 1980

[54] ELECTRICAL TERMINAL CLAMP FOR THE ESTABLISHMENT OF AN ELECTRICALLY CONDUCTING CONNECTION

[76] Inventor: Axel Olsen, Fortunvej 86, DK-2920 Charlottenlund, Denmark

[21] Appl. No.: 902,223

[22] Filed: May 2, 1978

[51] Int. Cl.[3] ..... H01R 9/08

[52] U.S. Cl. ..... 339/97 R

[58] Field of Search ..... 339/97 R, 97 P, 98, 339/99 R

[56] References Cited

U.S. PATENT DOCUMENTS

| | | | |
|---|---|---|---|
| 3,129,995 | 4/1964 | Brown | 339/97 P |
| 3,585,572 | 6/1971 | Krone et al. | 339/97 R |
| 3,675,182 | 7/1972 | Gregory | 339/98 |

FOREIGN PATENT DOCUMENTS

| | | | |
|---|---|---|---|
| 2454212 | 5/1975 | Fed. Rep. of Germany | 339/97 R |

*Primary Examiner*—Joseph H. McGlynn

*Attorney, Agent, or Firm*—Watson, Cole, Grindle & Watson

[57] ABSTRACT

In an electrical terminal clamp for the establishment of an electrically conducting connection between an insulated conductor and a contact member rotatably mounted in a housing, said contact member is constructed with a non-cutting edge which performs a blunt scraping movement along and into the body of the conductor so as to first break through and displace the insulation, and then, upon engaging the exposed conductor, to deform the conductor plastically and without forming a notch.

9 Claims, 34 Drawing Figures

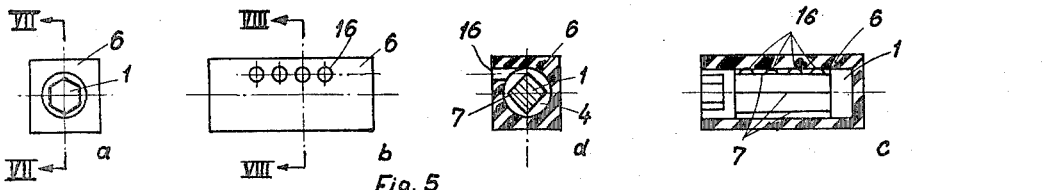
Fig. 5
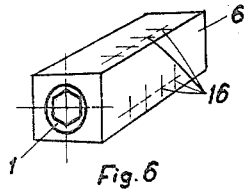
Fig. 6
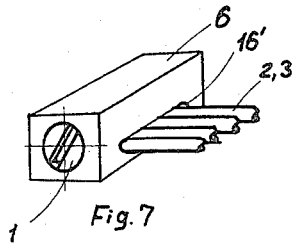
Fig. 7
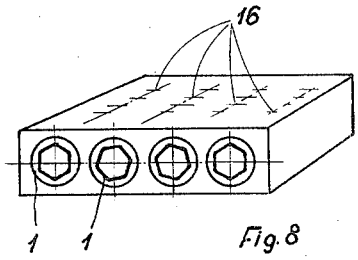
Fig. 8
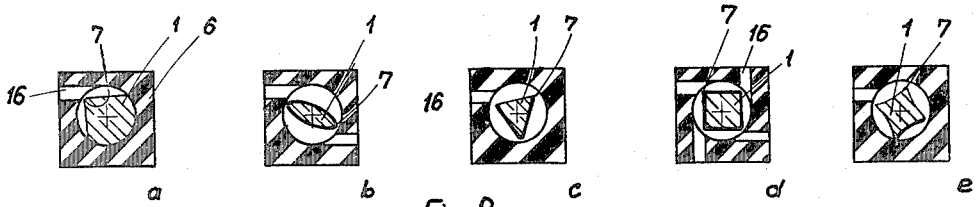
Fig. 9
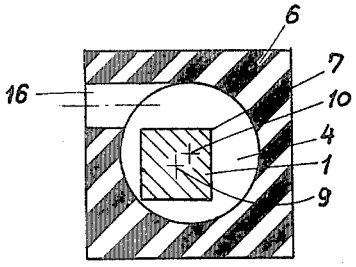
Fig. 10
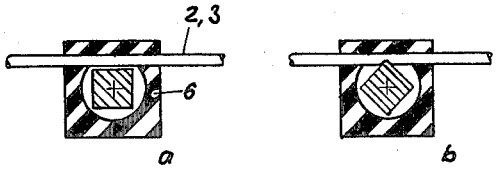
Fig. 12
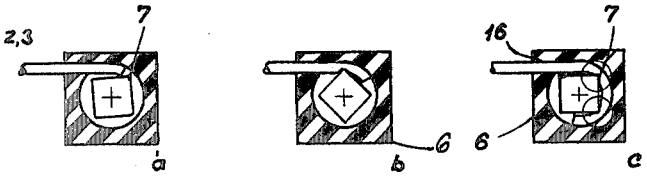
Fig. 11
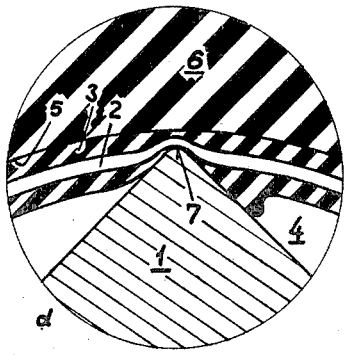

ELECTRICAL TERMINAL CLAMP FOR THE ESTABLISHMENT OF AN ELECTRICALLY CONDUCTING CONNECTION

BACKGROUND OF THE INVENTION

The present invention relates to an electrical terminal clamp for the repeatable establishment of an electrically conducting connection between an insulated conductor and a conductive contact member. The clamp comprises a housing with an opening for the introduction of an insulated conductor of substantially circular cross-section and an inner cavity in which there is mounted an electrically conductive contact member which is movable, preferably turnable, from a first position in which there is sufficient space between the contact member and the wall of the cavity for the introduction of an insulated conductor, to a second position in which, upon stripping of the conductor and establishment of contact between the conductor and the contact member, a clamping slot is formed between the contact member and the wall of the cavity.

From British patent specification No. 954,917 an electrical terminal clamp of the type described is known in which the contact member is constructed with a cutting edge which first cuts through the insulation layer and is then pressed into the metallic conductor itself to establish contact between the cutting edge and the material of the conductor. In establishing contact, the cutting edge forms a notch in the material of the conductor and thereby weakens the conductor such that rupture propagation may occur from the notch in the course of time or under the influence of vibrations or shocks. This is a problem which is well-known in the establishment of electrically conducting connection with a single core conductor without first stripping the conductor. Furthermore in the case of multifilament conductors, it is a disadvantage that the electrical connection is established, following a cutting operation, by the cutting edge that performed that operation, because the filaments extending transversely of the cutting edge are injured while on the other hand the contact pressure between the cutting edge and the filaments extending longitudinally of the cutting edge is usually rather low so that the electrical connection is unreliable and sparking may occur.

From British patent specifications Nos. 1,149,685 and 1,403,284, German published application No. 1,803,397, and U.S. Pat. No. 3,675,182, terminal clamps are known in which the contact member is constructed with two separate zones, one of which has a cutting edge by means of which the stripping is performed, while the other zone provides the clamping and the establishment of contact with the stripped conductor. A consequence of this arrangement is that the housing must have relatively large dimensions and that a relatively great movement of the contact member is required before the electrical connection is established.

From Danish patent specification No. 127,145 a terminal clamp of the kind in question is known where the stripping and the establishment of the electrical contact are effected in the same zone of the insulated conductor by the pressure of a rounded pressing member when the insulated conductor is clamped between the wall of the cavity and the pressing member so that the metallic conductor itself breaks through its insulation both on the side of the pressing member and on the side of the opposite wall portion of the cavity. By breaking through the insulation, metallic contact is obtained both with the wall of the housing and with the pressing member. Since the pressing member, also referred to as clamping nose, is constructed in such a manner as to cause the metallic conductor itself to break through the insulation, the clamping force required for breaking through the insulation depends both on the size of the radius of the metallic conductor and of the length of this conductor engaged by the clamping nose. The same applies to the clamping force required for establishing the contact pressure between the conductor and the clamping nose and the wall, respectively.

SUMMARY OF THE INVENTION

The clamping terminal according to the invention is characterized in that the contact member is constructed with a non-cutting edge which is so shaped and arranged that during movement of the contact member from its first to its second position, the member performs a blunt scraping movement along and into the body of the conductor so as to first break through and displace the insulation and then, upon engaging the exposed conductor, to deform the conductor plastically and without forming a notch. As a result, the drawbacks referred to above are remedied, first because a cutting edge is avoided and second because a relatively high contact pressure between the conductor and the edge can be established with a relatively low clamping force and without any risk of the formation of rupture-promoting scars in the material of the conductor regardless of whether the conductor is a single-core or a multi-filament. Moreover, in the case of a single-core conductor, both the contact area and the contact pressure can be considerably higher than has been possible when using a contact member with a cutting edge. Similarly, in the case of multi-filament conductors, the higher contact pressure and the higher contact area establish an improved conducting connection partly between the edge and the filaments engaged by the same, and partly between the filaments mutually in the zone of the contact member.

Furthermore, the local plastic notch-free deformation of the stripped conductor is effected at a clamping force which is relatively independent of the diameter of the naked conductor and the edge cooperates with the wall of the cavity which serves both as guiding surface for the placing of the insulated conductor in the cavity and as counter pressure surface and frictional surface for the insulated conductor when the conductor is subjected to the influence of the edge. As compared with the clamping terminal known from Danish patent specification No. 127,145, the advantage is also obtained that as a consequence of the use of a non-cutting edge instead of a rounded clamping nose, a considerably lower clamping force per contact point is required for a particular contact pressure between the conductor and the pressing member. This advantage is particularly important when the diameter of the conductor or the number of conductors is increased or when the number of contact points between the conductor and the contact member is increased, considering that the torque required for turning the contact member should preferably be kept so low that it can be produced without difficulty by means of a simple tool such as a screwdriver. Moreover, in comparison with the known clamping terminal, the required clamping force is reduced, the wear on the movable parts of the clamping terminal is reduced, and the lifetime is correspondingly increased which is quite important for a terminal clamp intended for repeatable use. Finally, it should be mentioned that an insulated conductor connected in the terminal clamp according to the present invention is not appreciably damaged by the establishment of the contact and the contact is moreover limited to a relatively small area of the conductor so that a repeated establishment of the electrical connection between a conductor and the contact member can be effected without cutting off the length of the conductor used for the previous establishment of contact. If the conductor is just turned a small angle about its longitudinal axis from its previous position in the terminal clamp, or the conductor displaced a short distance in the longitudinal direction, the next establishment of contact will be just as efficient as the former one. If the establishment of contact is effected in such a manner that the naked conductor is not brought into contact with the wall of the cavity or, in other words, in such a manner that after the establishment of contact the insulation is still present between the conductor and the wall, the repeated establishment of contact can even be effected at the same place as previously since the required contact pressure can be exerted by the compressional force of the insulation.

Advantageously, the non-cutting edge is rounded and has a radius of curvature less than 1 mm. In the case of conductors with a core diameter less than 2 mm, the radius of curvature of the non-cutting edge is preferably smaller than the nominal radius of the naked conductor.

In the second position of the contact member, the front face of the non-cutting edge may preferably form an angle between 30° and 90° with the longitudinal direction of the conductor. By choosing the angle within these limits, the area of contact between the contact member and the conductor can be varied.

Due to the relatively low clamping force required for a single conductor, the housing, the cavity and the non-cutting edge may be constructed for simultaneously engaging a plurality of conductors of equal diameter to break through their insulation and to establish contact between them across the contact member.

If a terminal clamp according to the present invention is to be used for receiving a plurality of conductors of different types, the contact member may be constructed with a non-cutting edge portion for each type of conductor and the cavity constructed with wall portions corresponding to the different non-cutting edge portions.

In order to increase the contact area for each conductor the contact member may be constructed with a plurality of non-cutting edges adapted during the movement of the contact member to successively break through and displace the insulation at different positions of the insulated conductor and to establish contact with the exposed conductor in these positions.

If in the latter case the movement of the non-cutting edges takes place by turning the contact member, a reduction of the bearing pressure of the contact member in the housing can be obtained by uniformly distributing the non-cutting edges over the periphery of the contact member and turning the contact member sufficiently to engage all of these non-cutting edges with the conductor or each conductor.

If the distance between the wall of the cavity and the non-cutting edge or edges co-operating therewith is constant during the movement of the non-cutting edge or edges in the cavity, the contact pressure once established between the naked conductor and the edge remains constant during the continued movement of the edge. This is particularly advantageous when the edge is to be electrically connected with the conductor or conductors in successive positions.

If, on the other hand, the distance between the wall of the cavity and the non-cutting edge or edges co-operating therewith varies during the movement of the non-cutting edge or edges in the cavity, the contact pressure on the naked conductor and the friction of the conductor against the wall of the cavity are gradually increased during the final part of the movement of the edge. Moreover, this construction can be used for insulated conductors, the nominal diameter of which varies within wider tolerance limits.

If the non-cutting edge extends along the contact member in the form of a helical line instead of perpendicularly to the conductor, an increase of the contact area may be obtained.

BRIEF DESCRIPTION OF THE DRAWINGS

FIG. 5*a* is a front view of one form of a terminal clamp according to the invention with a rotatable contact member.

FIG. 5*b* is a side view of the terminal clamp of FIG. 5*a*.

FIG. 5*c* is a longitudinal section of the same terminal clamp along the line VII—VII in FIG. 5*a*.

FIG. 5*d* is a cross section through the same terminal clamp along the line VIII—VIII in FIG. 5*b*.

FIG. 6 is a perspective view of a terminal clamp with introduction passages from several sides.

FIG. 7 is a perspective view of a terminal clamp with a wide introduction passage.

FIG. 8 is a perspective view of a unit comprising several terminal clamps.

FIGS. 9*a*–9*e* are cross sections through various forms of terminal clamps with rotatably mounted contact members.

FIG. 10 is a cross section through a terminal clamp with a contact member mounted eccentrically in the cavity.

FIG. 11*a* is a cross section corresponding to the line VIII—VIII in FIG. 5*b* through a terminal clamp with the contact member in the position of introduction.

FIG. 11*b* is a similar cross section with the contact member in a single-contact position.

FIG. 11*c* is a corresponding section with the contact member in a double-contact position.

FIG. 11*d* is an enlarged view of the parts within the marking circles in FIG. 11*c*.

FIG. 12*a* is a section corresponding to the line VIII—VIII in FIG. 5*b* through a terminal clamp where the insulated conductor extends through the housing, the contact member being located in the position of introduction.

FIG. 12*b* is a corresponding section where the contact member has been moved to the contact establishing position.

FIG. 13*a* is a longitudinal section perpendicular to that of FIG. 13 through a terminal clamp in which the non-cutting edge extends along a helical line.

DESCRIPTION OF THE PREFERRED EMBODIMENTS

Figure 1A:
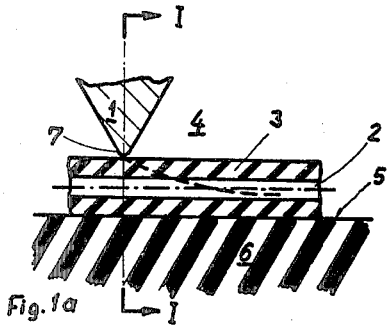
FIG. 1*a* is a diagrammatic longitudinal section through a conductor introduced into the cavity of a terminal clamp before the breaking through of the insulation and the establishment of contact between the conductor and the non-cutting edge of the contact member.
Figure 1B:
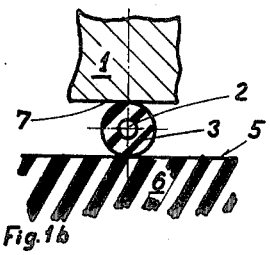
FIG. 1*b* is a section along the line I—I in FIG. 1*a*.
Figure 2A:
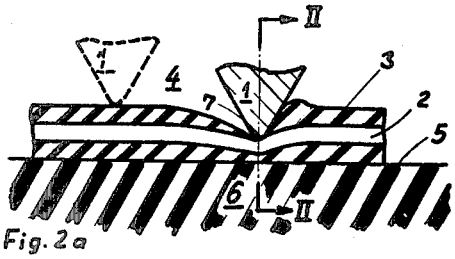
FIG. 2*a* is a longitudinal section corresponding to FIG. 1*a* after the layer of insulation has been broken through and the contact member has been brought into conducting contact with the thus exposed conductor.
Figure 2B:
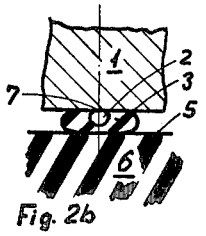
FIG. 2*b* is a section along the line II—II in FIG. 2*a*.
Figure 2C:
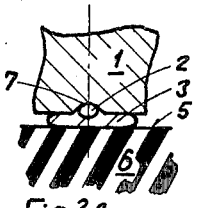
FIG. 2*c* is a section similar to FIG. 2*b* illustrating a different configuration of the non-cutting edge.
Figure 2D:
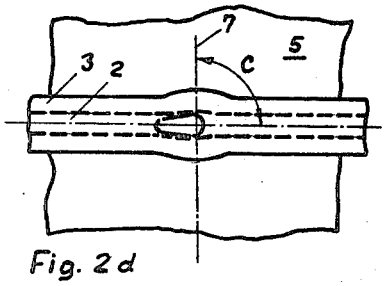
FIG. 2*d* is a top view corresponding to FIG. 2*a* with omission of the contact member, the cutting edge of which is in this case supposed to extend transversely to the conductor.
Figure 2E:
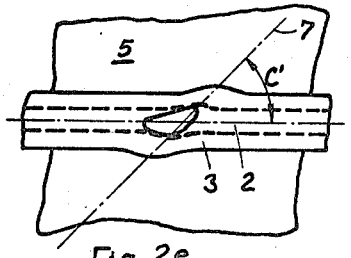
FIG. 2*e* is a similar top view to FIG. 2*d*, in which the edge of the contact member is presumed to extend at an inclination.

In FIG. 1*a*, an electrically insulated conductor 2,3 consisting of a conductor 2 and a surrounding layer of insulation 3 has been introduced into a cavity 4 of a housing made from an electrically insulating material 6 along the wall 5 of the cavity. In the cavity, provided is an electrically conducting contact member 1, which is only partially shown in FIG. 1*a*. The contact member 1 is constructed with a non-cutting edge 7 which is moved by the contact member 1 in a blunt scraping movement along the conductor 2 and into the body of the same so as to break through and displace the layer of insulation 3 on the side facing the contact member 1 and thereafter to deform the stripped conductor locally without forming a notch, the contact member 1 being pressed against the stripped conductor 2 under a predetermined pressure and moved a short distance along the conductor. FIG. 2*a* shows the situation where metallic contact has been established between the edge 7 and the conductor 2. The layer of insulation 3 is in this case elastically resilient and capable of being compressed so as to exert a pressure on the side of the conductor 2 facing away from the contact member 1, which pressure is opposed to that exerted by the contact member 1, whereby the conductor 2 becomes slightly curved in the zone of the edge 7. The pressure produces the contact pressure required for the conducting connection as well as a certain friction for holding the insulated conductor 2,3 in engagement with the wall 5 of the cavity. The curvature produces an enlargement of the area of contact between the edge 7 and the conductor 2 as well as an increase of the resistance of the insulating conductor 2,3 to displacement relative to the contact member 1. FIG. 1*b* shows a section along the line I—I in FIG. 1*a* through the parts shown in that figure before the establishment of contact where the conductor 2 and the layer of insulation 3 have circular cross sections and the edge 7 extends rectilinarly parallel to the wall 5 of the cavity which may be plane or cylindrical. FIG. 2*b* is a corresponding cross section along the line II—II in FIG. 2*a* after the establishment of contact. FIG. 2*c* shows a similar section where the edge 7 is not rectilinear. FIG. 2*d* illustrates the situation of FIG. 2*a* in top view, the contact member 1 being removed and the edge 7 being marked by a line, which in this case forms an angle C=90° with the conductor. This latter figure illustrates that the edge has broken through the insulation and has deformed both the conductor 2 and the insulation 3. In FIG. 2*e*, the edge 7 extends at an inclination to the conductor 2 in the position of contact, the angle of inclination being denoted by C'. In this case the area of contact and deformation of the conductor 2 and the area of deformation of the insulation 3 are enlarged. In addition to the plastic deformation of the conductor 2, this is also to some extent elastically deformed in the area of contact and the same holds true for the insulation 3.

Figure 3A:
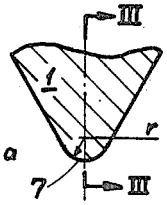
FIG. 3*a* is one form of the marginal portion of the contact member in cross section along the line IV—IV in FIG. 3*b*.
Figure 4A:
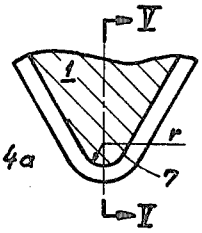
FIG. 4*a* is a modified form of the marginal portion of the contact member in section along the line VI—VI in FIG. 4*b*.
Figure 3B:
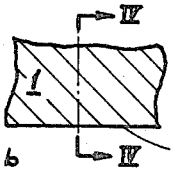
FIG. 3*b* is a section along the line III—III in FIG. 3*a*.
Figure 4B:
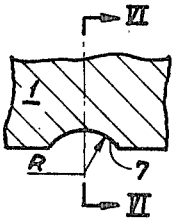
FIG. 4*b* is a section along the line V—V in FIG. 4*a*.

The edge 7 of the contact member 1 is shown on a larger scale in FIG. 3*a*. From this figure it is apparent that the edge is not sharp, but has a radius of curvature r. In the case of insulated conductors having a great core diameter, e.g. greater than 2 mm, the radius of curvature r is less than 1 mm. This radius of curvature is determined by experiment for the dimension or dimensions of conductors for which the terminal clamp is intended to be used. As an example, it has been found that a radius of curvature $r=0.2\ mm\pm0.1\ mm$ is suitable for the single-core insulated conductors used for telephone circuits. The radius of curvature r depends also on the desired contact pressure and on the thickness and type of the layer of insulation 3. FIG. 3*b* shows a section along the line III—III in FIG. 3*a*, where the edge 7 extends along a straight line perpendicularly to the rounded portion, FIG. 3*a* being a section along the line IV—IV in FIG. 3*b*. The rectilinear construction shown in FIG. 3*b* is suitable for use where the insulated conductor 2,3 is guided by guiding members which define the path of the conductor into and through the cavity 4, while the construction shown in FIGS. 4*a* and 4*b* eliminates the necessity of such guiding members and increases the contact area between the edge 7 and the stripped conductor 2, the edge 7 having a curvature with the radius of curvature R.

FIGS. 5*a–d* show a terminal clamp according to one embodiment of the present invention. FIG. 5*a* is a front view of the terminal clamp and in this embodiment, the contact member 1 is rotatably mounted in the housing 6 and the turning of the contact member may be performed by introducing a hexagonal key into the hexagonal recess illustrated and then turning the key. Instead of the hexagonal recess, the contact member may be constructed with a projection serving as an operating handle for turning the contact member. Recesses of different shapes may also be used depending on the desired form of tool to be used. Instead of the recess, the contact member may be constructed with a projection which can be gripped by a key. In FIG. 5*b*, the terminal clamp is seen from a side where insulated conductors 2,3 may be passed through openings or introduction passages 16 into the cavity 4 or through the cavity when the contact member is in the first position in which the insulated conductor can be introduced between the contact member 1 and the wall 5 of the cavity. When the contact member is thereafter turned in the clockwise direction in the embodiment illustrated, the space available for the insulated conductor 2,3 between the wall 5 and the edge 7 is reduced until, as a consequence of the shape and arrangement of the edge and the shape of the cavity, space is only left for the conductor itself and a smaller portion of the insulating layer 3. As a consequence, the pressure exerted by the edge becomes sufficient to locally displace the insulating layer 3 and to produce the local plastic notch-free deformation of the conductor material and the compression of the portion of the insulating layer 3 in contact with the wall 5 of the cavity on the other side of the conductor.

FIG. 6 shows a terminal clamp with introduction passages 16 extending into the cavity 4 from several sides so that an electric connection can be established across the contact member 1 between a plurality of conductors introduced in different directions by a single turning movement of the contact member 1. The form of the contact member 1 shown in FIG. 5*d* is particularly suitable for this purpose. FIG. 7 shows a terminal clamp with a side introduction passage 16' for the introduction of several insulating conductors 2,3 in a side by side relationship. In FIG. 8, a plurality of terminal clamps located side by side are arranged in a common housing.

The housing of the terminal clamp may advantageously consist wholely or partly of a transparent material so that it is possible to observe before the contact-establishing operation whether all insulated conductors 2,3 and the contact member 1 are in the proper positions.

FIGS. 9*a–e* show various examples of the cross sectional shape of the contact member 1 and the arrangement of introduction passages 16. The number of edges 7 varies from one to four and the surfaces of the contact member 1 between the edges can be convex, concave or planar. The introduction passages 16 can be present in varying numbers and extend in various ways in relation to the wall of the cavity. In all the examples of FIGS. 9*a–e*, the wall 5 of the cavity is cylindrical and the contact member 1 is rotatable about the axis of the cavity. The edge 7 extends along a straight line parallel to the axis of the cavity 5, but it may also extend along a helical line parallel to the wall 5 of the cavity.

FIG. 10 shows an embodiment in which the contact member 1 is eccentrically mounted relative to the axis of the cavity wall 5. This embodiment is particularly suitable for insulated conductors in which the dimensions may vary appreciably or where the same terminal clamp is to be used for several different dimensions of insulated conductors. However, in a terminal clamp of this kind, the conductors can be introduced into the cavity only in one direction, whereas, e.g., in the embodiments shown in FIGS. 9*d* and 9*e*, conductors can be introduced in four different directions. If it is desired to combine the advantages of the embodiment of FIG. 10 with those of the embodiments of FIGS. 9*d–e*, this is possible by constructing the cavity 5 with a cross sectional shape other than cylindrical. Thus, in FIG. 9*e*, the cavity wall may be constructed with elliptical cross section.

FIGS. 11*a–c* illustrate the stripping and the establishment of contact when using a contact member 1 which is rotatably mounted coaxially with the axis 8 of the cavity wall 5. FIG. 11*a* shows the introduction of the insulated conductor 2,3 into the cavity 4, while FIGS. 11*b* and 11*c* show the establishment of contact with the same conductor 2 at the first and the second edge 7, respectively. When introducing the insulating conductor 2,3 along the cavity wall 5, the first edge 7 moves the conductor forwards until the second edge engages the insulated conductor, whereafter both edges after having established conducting contact with the conductor 2 move the conductor further forwards so that if desired the third and the fourth edges 7 are also engaged with the conductor 2. FIG. 11*d* illustrates on a larger scale the situation prevailing in the areas within the marking circles in FIG. 11*c*. As apparent from this figure, the conductor 2 has been deformed without the formation of a notch so as to form a bend around the edge 7 and to compress the insulating layer 3 on the side facing away from the edge 7. Due to the breaking through of the insulation 3, the insulation is somewhat compressed on the front side of the edge 7 and somewhat expanded on the rear side of the edge 7. When this form of establishment of contact is effected in a plurality of positions of the same conductor or, if desired, more conductors, each conductor is firmly anchored at the cavity wall 5 under the influence of the contact member 1 so as to provide at the same time an efficient safety against pulling forces on the conductor.

FIGS. 12*a* and 12*b* illustrate the stripping and the establishment of contact in a terminal clamp which differs from that of FIGS. 11*a–c* only in that the housing 6 of the terminal clamp has a through passage through which the insulated conductor 2,3 is passed. The through passage can be constructed with or without a lateral opening of L-shaped cross section, which opens at the surface of the terminal clamp and through which the conductor 2,3 can be introduced into position in contact with a portion of the cavity wall 5. In this manner it becomes possible to connect the terminal clamp according to the invention with a previously mounted insulating conductor 2,3 without first detaching the conductor from its electrical circuit.

Figure 13:
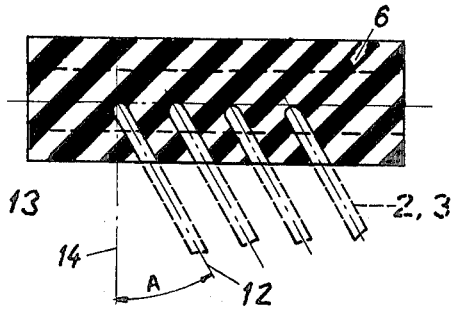
FIG. 13 is a longitudinal section through a terminal clamp with inclined introduction passages.

The section of FIG. 13 through a housing 6 with inclined introduction passages shows that in the position where the introduction passages 16 for the insulated conductors 2,3 intersect the cavity wall 5, they form an angle A with a plane perpendicular to the axis of rotation 8 of the contact member 1. For clarity of illustration, the contact member 1 has been removed from the cavity 4, in which the contact member is rotatably mounted. The angle A can advantageously have a size between 0°–60° depending on whether it is desired or not that each insulated conductor should be subjected to a bend at the opening of the introduction passage 16 in the cavity 4. If the contact member 1 has edges extending along the axis of rotation 8, the bend becomes as small as possible at $A=0°$ and as great as possible at $A=60°$. If the edge 7 of the contact member 1 extends along a helical line about the axis of rotation 8 as illustrated in FIG. 13*a*, the bend becomes insignificant when the introduction passage 16 extends perpendicularly to the edge or edges 7, which are engaged with the insulated conductor 2,3. If e.g. the inclination of the helical line to a plane perpendicular to the axis of rotation 8 amounts to 60°, the bend becomes insignificant at an angle $A=60°$. By choosing the inclination of the helical line, the bend may therefore be varied and at the same time, an advantage is obtained in that the edge 7, while performing its movement for stripping and establishment of contact, is moved not only through a distance longitudinally of the conductor, but also through a distance transversely of the conductor. Consequently, the resultant movement of the edge 7 relative to the conductor 2,3 is increased and the establishment of contact may therefore be effected by a smaller turning movement of the contact member 1.

Figure 14:
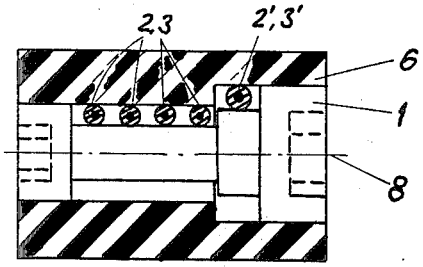
FIG. 14 is a longitudinal section through a terminal clamp for conductors of different dimensions, the contact member being located in the position of introduction.
Figure 15:
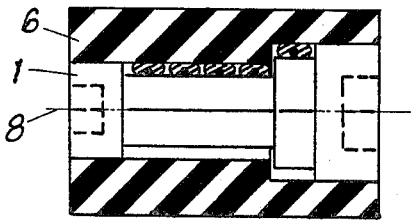
FIG. 15 a corresponding section where the contact member has been moved to its contact establishing position.

FIGS. 14 and 15 show an example of a terminal clamp according to the invention for insulated conductors 2,3 and 2',3' having different diameters, before and after the stripping and the establishment of contact. It will be seen from the figure that both the edge 7 and the portion of the cavity wall co-operating therewith are adjusted to the dimensions of the respective conductors. The same applies to the length of the edge and the length of the portion of the cavity wall co-operating therewith, as measured in the direction of the axis of rotation 8. Although the housing 6 of the terminal clamp consists of electrically insulated material, the wall 5 of the cavity 4 need not be electrically insulating but can be constructed with an electrically conducting surface facing the cavity and the contact member 1.

I claim:

1. An electrical terminal clamp which comprises a housing having a cavity with a cylindrical wall and including at least one opening for allowing at least one insulated conductor to be inserted therethrough and into said cavity, an electrically conductive contact member mounted for rotation within said cavity about a fixed axis, said contact member having a non-cutting scraping edge oriented so as to be generally transverse to a center line through each of said openings in said housing, said contact member being mounted so as to be movable from a first position at which an insulated conductor can be introduced through said at least one opening in said housing and be freely movable within said cavity, to a second position wherein an insulated conductor extending through said at least one opening into said cavity will be clamped between said scraping edge of said contact member and the wall of said cavity, said non-cutting scraping edge being rounded and having a radius of curvature less than 1 mm such that when an insulated conductor extends through said at least one opening and into said cavity and said contact member is moved from said first position to said second position, said scraping edge will break through and displace the insulation and then upon engaging the exposed conductor to establish contact therewith, will take the conductor along in its further movement along the wall of the cavity.

2. An electrical terminal clamp as defined in claim 1, in which the radius of curvature of the non-cutting edge is less than the nominal radius of the conductor portion of an insulated conductor placed therein.

3. An electrical terminal clamp as defined in claim 1, in which, in the second position of the contact member, the front face of the non-cutting edge forms an angle of between 30° and 90° with the longitudinal direction of the conductor.

4. An electrical terminal clamp as defined in claim 1, in which the contact member is constructed with a plurality of non-cutting edges adapted during the movement of the contact member successively to break through and displace the insulation at different positions of an insulated conductor located in the housing cavity and to establish contact with the exposed conductor in these positions.

5. An electrical terminal clamp as defined in claim 1, in which the internal walls forming said cavity in said housing and said contact member are shaped such that the distance between the walls of the cavity and the non-cutting edge co-operating therewith is constant during the movement of the non-cutting edge or edges within the cavity.

6. An electrical terminal clamp as defined in claim 1, in which the internal walls forming said cavity in said housing said contact member are shaped such that the distance between the walls of the cavity and the non-cutting edge co-operating therewith varies during the movement of the non-cutting edge or edges within the cavity.

7. An electrical terminal clamp as defined in claim 1 for a single-core telephone conductor, in which the non-cutting edge has a radius of curvature of the order of size of 0.2 mm.

8. An electrical terminal clamp as defined in claim 1 wherein said housing includes a multiplicity of openings of equal diameter therein for allowing multiple insulated conductors having uniform diameters to be inserted respectively therethrough and into said cavity such that said scraping edge of said contact member will simultaneously break through their insulations and engage their exposed conductors when said contact member is moved from its first to its second position.

9. An electrical terminal clamp as defined in claim 1 wherein said housing includes a multiplicity of openings of differing diameters therein for allowing multiple insulated conductors having correspondingly different diameters to be inserted respectively therethrough and into said cavity, and wherein said contact member is shaped such that the non-cutting edge portion thereof will be able to simultaneously break through their insulations and engage their exposed conductors when said contact member is moved from its first to its second position.

* * * * *